US005934453A

United States Patent [19]

Sugawara et al.

[11] Patent Number: 5,934,453

[45] Date of Patent: Aug. 10, 1999

[54] KEY TOP HOLDING STRUCTURE

[75] Inventors: Shuuichi Sugawara; Kazuhiro Ikeda, both of Miyagi; Kenichi Nishikawa, Kanagawa, all of Japan

[73] Assignee: Matsushita Electric Industrial Co., Ltd., Osaka, Japan

[21] Appl. No.: 09/158,258

[22] Filed: Sep. 22, 1998

[30] Foreign Application Priority Data

Sep. 24, 1997 [JP] Japan ..... 9-274933

[51] Int. Cl.[6] ..... H01H 3/00

[52] U.S. Cl. ..... 200/339; 200/341

[58] Field of Search ..... 200/1 V, 1 B, 200/557, 512, 513–517, 339, 315, 341–345

[56] References Cited

U.S. PATENT DOCUMENTS 4,045,650 8/1977 Nestor ..... 200/153 K
4,520,240 5/1985 Swindler ..... 200/5 R

FOREIGN PATENT DOCUMENTS 60-175330 9/1985 Japan .
63-254629 10/1988 Japan .
2-42292 3/1990 Japan .

*Primary Examiner*—Michael L. Gellner
*Assistant Examiner*—Nhung Nguyen
*Attorney, Agent, or Firm*—Pearne, Gordon, McCoy & Granger LLP

[57] ABSTRACT

A center shaft (2*a*) for holding a key top (1), and springs (2*b*) are provided in a casing (2) of a small-sized electronic equipment such as an inter-call receiver. The springs (2*b*) are provided so as to extend from the peripheral portions toward the center shaft (2*a*), and holes are formed in the springs (2*b*) respectively. The key top (1) is provided with a stopper nail (1*a*), first protrusions 1*b* and second protrusions 1*c*. The protrusions (1*c*) of the key top (1) for pushing switches (3) are inserted through the holes of the springs (2*b*) respectively, and the stopper nail (1*a*) of the key top (1) is engaged with the center shaft (2*a*) acting as a fulcrum during the seesawing operation of the key top (1). Thus, the key top (1) is held in a stable manner. The existence of the center shaft (2*a*) prevents simultaneous depression of the two switches (3).

24 Claims, 6 Drawing Sheets

KEY TOP HOLDING STRUCTURE

BACKGROUND OF THE INVENTION

The present invention relates to a structure for holding a key top used in a small-sized electronic equipment such as an inter-call receiver or the like, and particularly relates to a structure for holding a key top, which is simple and with which the key top can be attached to a casing easily and held stably.

One or more switches are provided in a small-sized electronic equipment such as an inter-call receiver or the like. A key top good and stable in manipulability of the switches, and low in manufacturing cost has been desired.

A conventional key top is arranged such that a key top itself is constituted by a spring structure or an elastic material, or otherwise, a spring, a cushion or the like acting as an elastic member for return operation is interposed between a casing and a key top, as disclosed in JP-U-2-42292, JP-A-63-254629, JP-A-60-175330, and so on.

The key top of this type cannot employ a complicated holding structure to stabilize the key operation in a case where it is applied to a small-sized electronic equipment such as an inter-call receiver or the like, since the small-sized electronic equipment generally has switches disposed close to each other and thus no sufficient space is provided for installation of the holding structure.

Such a key top is also available, that an elastic material or a spring structure was adopted for the key top per se in order to stabilize the key operation or in order to prevent abnormal sound or looseness from being caused by vibration of a calling vibrator or speaker singing. The key top is attached to the inside of a casing. The key top requires an additional extra holding mechanism, or the use of an elastic member such as a spring, a cushion or the like to possess the returnability of the key top. This results in the increased number of component parts, and the complicated assembly.

SUMMARY OF THE INVENTION

It is an object of the present invention to reduce the number of component parts by using a simple structure of a key top with no elastic material or spring structure in the key top per se or with no elastic member such as a spring, a cushion or the like in the key top per se.

It is another object of the present invention to stabilize the key operation, and to prevent abnormal sound or looseness from being caused by vibrations of a calling vibrator or speaker singing.

It is further another object of the present invention to make it possible to easily perform assembling from the outside of a casing, and to prevent occurrence of detachment due to external impact such as falling or the like.

To attain the above-noted objects, the present invention provides a key top holding structure for holding a key top on a casing to operate a switch. The key top holding structure includes a key top and a casing. The key top includes a first protrusion, a second protrusion and an elastic stopper nail. The casing includes a center shaft and a spring extending from a peripheral portion of the casing toward the central shaft. The key top is pivotably held on the casing by engagement between the stopper nail and the central shaft to depress the spring through the first protrusion and the switch through the second protrusion.

The key top holding structure can reduce the number of component parts by providing a spring structure in the casing. The operation and posture of the key top can be stabilized. The generation of the abnormal sound and looseness caused due to vibrations of a calling vibrator or loudspeaker can be surely prevented. Assembly can be also performed easily from the outside of the casing. The accidental detachment of the key top by an external impact can also be avoided.

The present disclosure relates to the subject matter contained in Japanese patent application No. Hei. 9-274933 (filed on Sep. 24, 1997) which is expressly incorporated herein by reference in its entirety.

DETAILED DESCRIPTION OF THE PREFERRED EMBODIMENTS

Next, preferred embodiment of the present invention will be described in detail with reference to FIGS. 1 to 6.

(First Embodiment)

Figure 1:
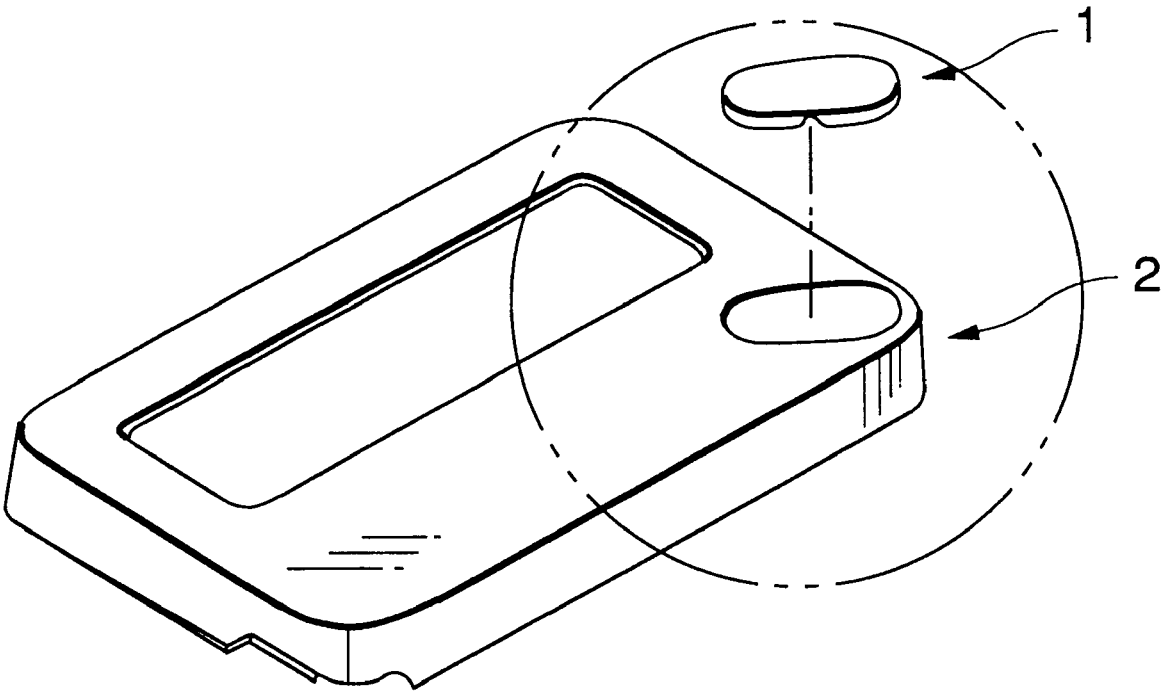
FIG. 1 is an exploded perspective view of a key top holding structure according to a first embodiment of the present invention.
Figure 2:
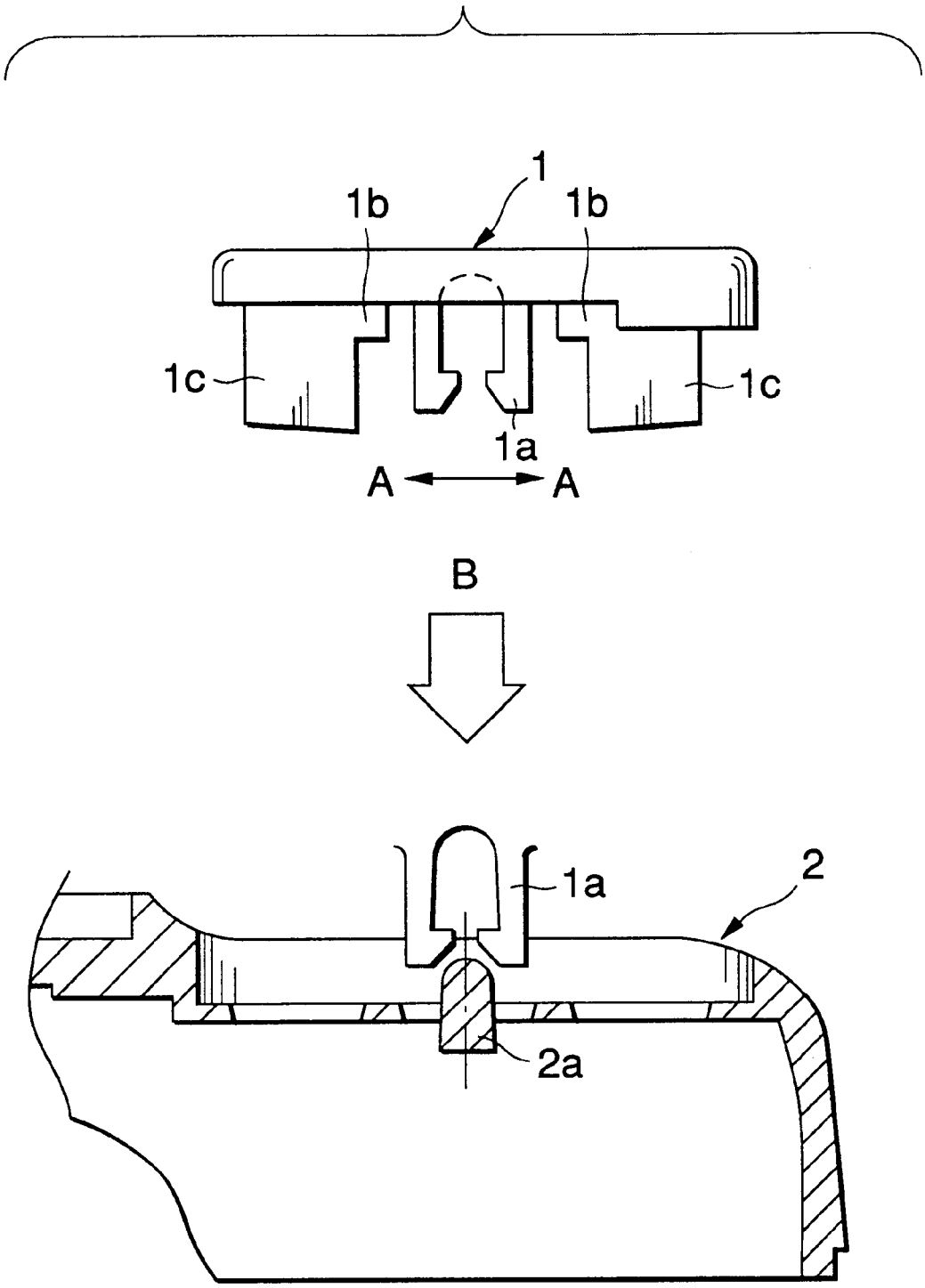
FIG. 2 is a sectional view showing how to incorporate the key top into a casing.
Figure 3:
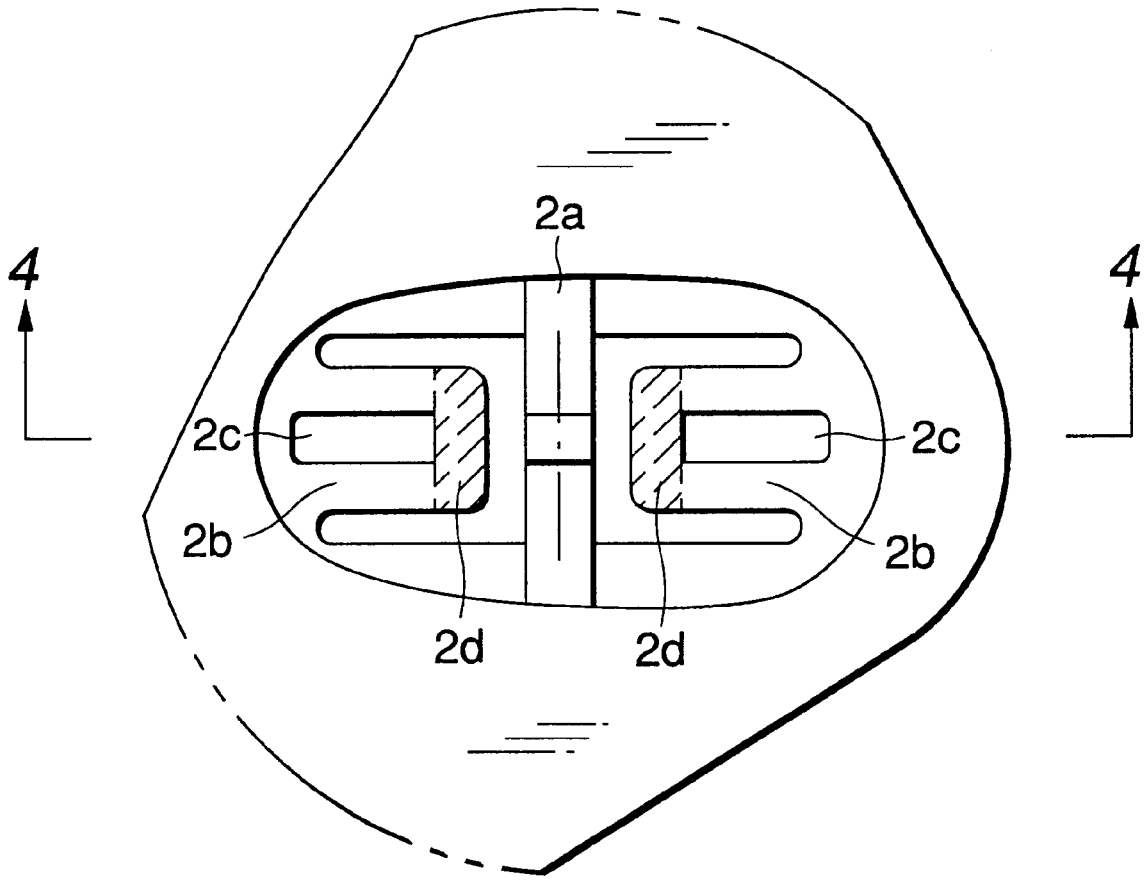
FIG. 3 is a plan view of a portion of the casing for receiving the key top.
Figure 4:
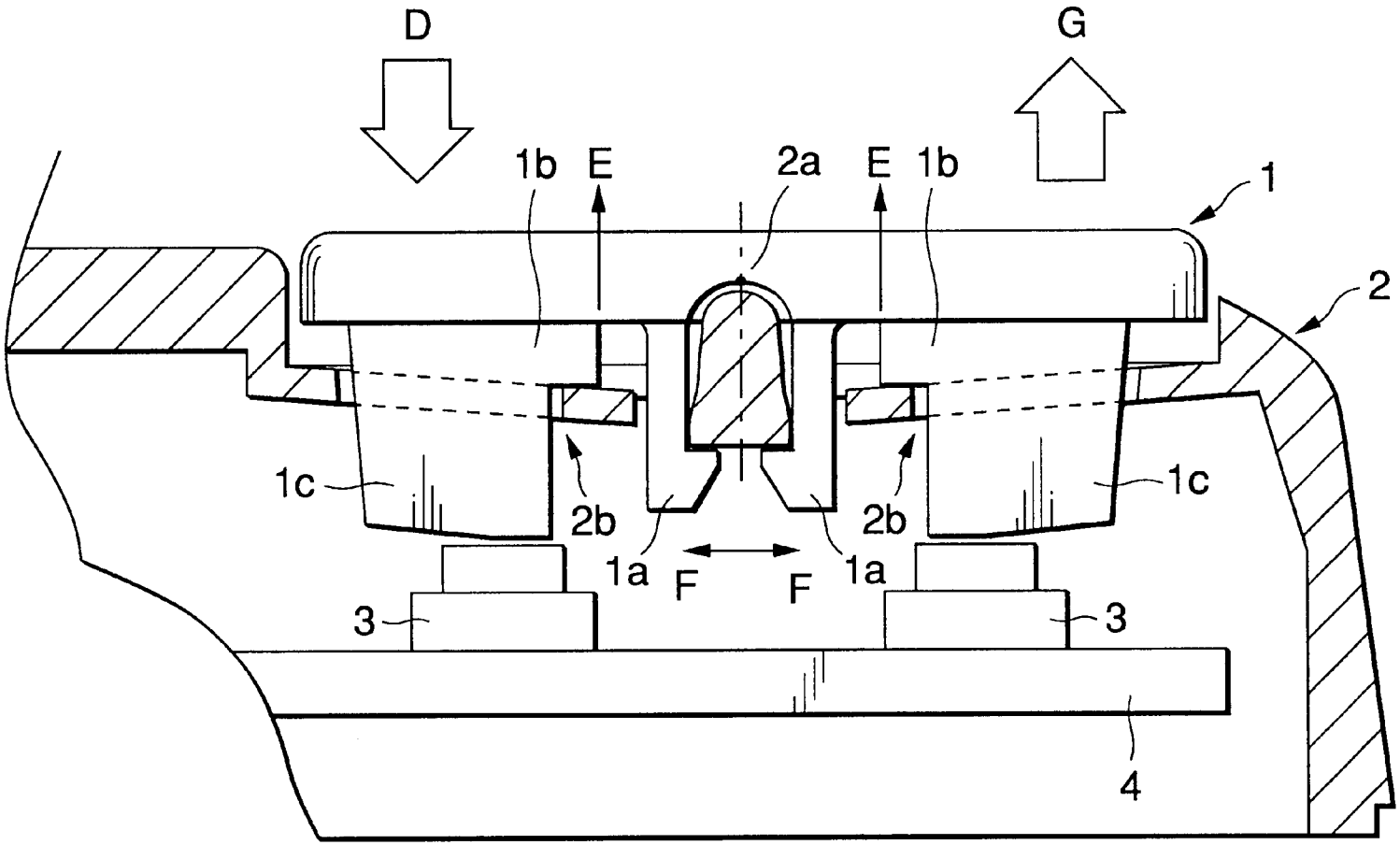
FIG. 4 is a sectional view taken along line 4—4 of FIG. 3, showing a state in which the key top is incorporated in the casing.
Figure 5:
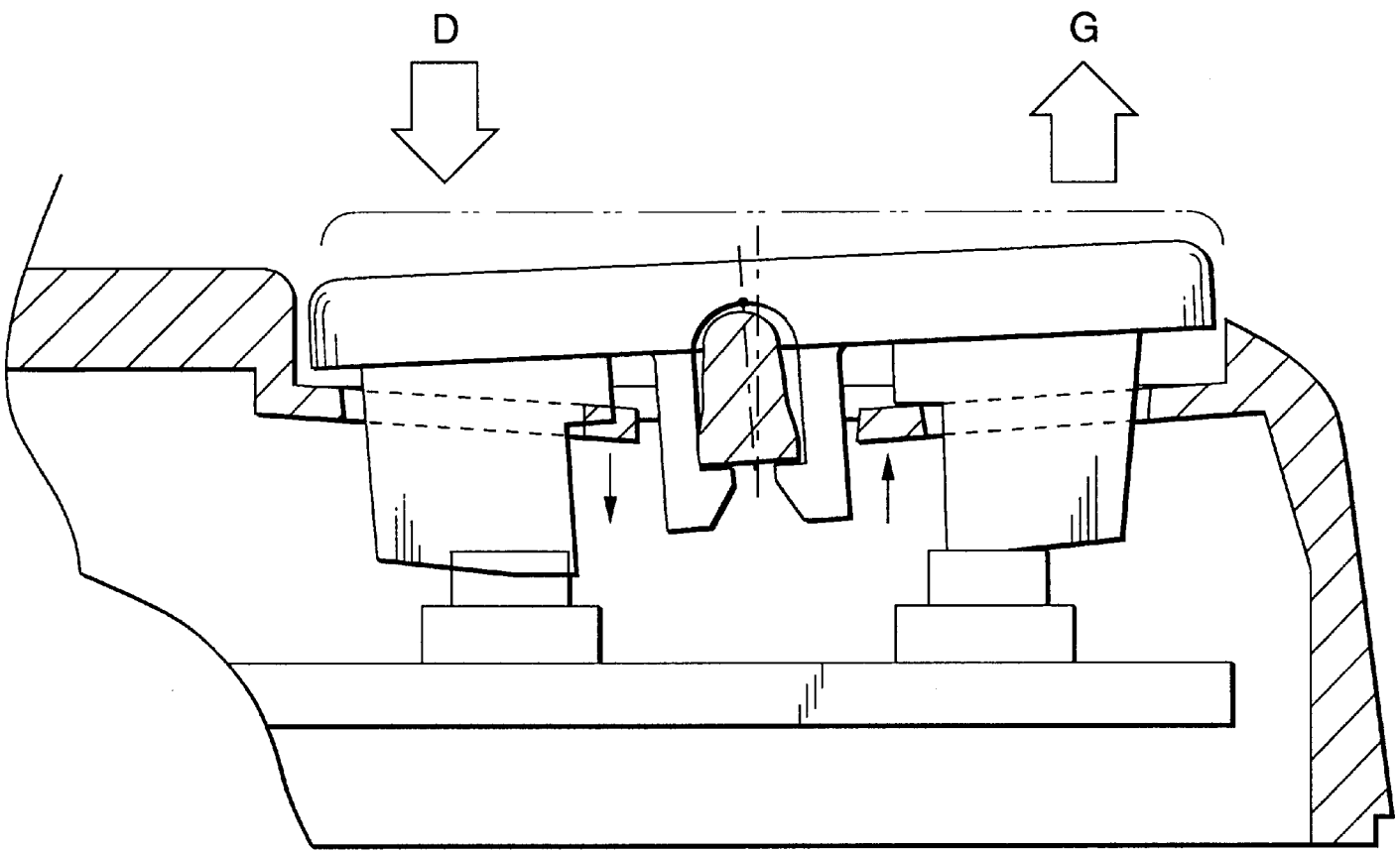
FIG. 5 is a sectional view showing a state in which the key top is pressed.

FIG. 1 is an exploded perspective view of a key top and a casing according to a first embodiment of the present invention. FIG. 2 is a sectional view showing how to incorporate the key top into the casing. FIG. 3 is a plan view of a portion of the casing where the key top is to be incorporated. FIG. 4 is a sectional view showing a state in which the key top is incorporated in the casing. FIG. 5 is a sectional view showing a state in which the key top is pushed. The key top and the casing are, for instance, molded from resin.

The method of assembling the key top will be described with reference to FIG. 2. First, a stopper nail 1*a* of a key top 1 is forced vertically onto a center shaft 2*a* of a casing 2 in the direction of the arrow B. The stopper nail 1*a* of the key top 1 is spread in the direction of the arrow A because of its own elasticity. As the stopper nails 1*a* of the key top 1 are fitted on the center shaft 2*a*, protrusion portions 1*b* for pushing springs 2*b* of the casing 2 abut against heads 2*d* (see FIG. 3) of the springs 2*b*, respectively. Each of the protrusion portions 1*b* acts as a point of application of the spring. On the other hand, protrusion portions 1*c* for pushing switches 3 are respectively inserted into holes 2*c* (see FIG. 3) of the springs 2*b* of the casing 2, so that the key top 1 can be prevented from rotating when the key top is inserted into the casing 2. When the stopper nail 1*a* is entirely fitted onto the center shaft 2*a*, the assembling is completed. Preferably, the upper surface of the center shaft 2*a* is formed into a spherical or tapered shape, so that the stopper nail 1*a* can be fitted onto the center shaft 2*a* smoothly. As described above, the key top 1 can be assembled easily from the outside of the casing 2.

Next, the shape of each of the springs 2*b* of the casing 2 will be described with reference to FIG. 3. Each spring 2*b* of the casing 2 extends toward the center shaft 2*a* from the periphery of a recess portion of the casing 2 in which the key top 1 is to be set. The spring 2*b* is formed at its central portion with a hole 2*c* into which the protrusion portion 1*c* of the key top 1 is to be inserted. The spring 2*b* is strong in structure because of its U-shape. Therefore, the spring 2*b* is substantially free from the adverse deformation due to a force when the casing 2 is removed from a molding die during resin-molding. In addition, a gradient for improving mold releasability during the resin-molding is given to the outer circumference of the spring 2*b* to suppress the adverse deformation of the spring. If the spring is not U-shaped and has a structure constituted by two thin spring members, the possibility of deformation of the spring during molding is high so that there is a fear that the quality lacks stability.

FIG. 4 shows the state in which the key top 1 is incorporated into the casing 2. Since the stopper nail 1*a* of the key top 1 is entirely fitted onto the center shaft 2*a* of the casing 2, the key top 1 cannot be removed from the casing 2 unless the stopper nail 1*a* of the key top 1 is forcibly spread in the direction F. That is, since the key top 1 cannot be taken off from the outside of the casing 2, it is possible to prevent the key top 1 from being detached by an external impact such as falling or the like.

In the state shown in FIG. 4, each spring 2*b* of the casing 2 is given downward tension by the corresponding protrusion 1*b* of the key top 1, whereas the key top 1 is always pushed in the direction E (upward) by the elastic force of the springs 2*b*. That is, the balanced elastic force of the two springs holds the key top 1 such that the protrusions 1*c* are spaced slightly from respective switches 3 on printed boards 4. Since the key top 1 always receives the tension vertically, it is possible to prevent abnormal sound or looseness from being caused by vibrations of a calling vibrator or speaker singing.

As shown in FIG. 5, the key top 1 is operated like a seesaw. When the key top 1 is pushed in the direction of the arrow D, the key top 1 rotates about the center shaft 2*a* of the casing 2 as a fulcrum, so that the switch 3 (left in the drawing) is pushed. In this condition, the tension by the right spring 2*a* in the direction of the arrow G about the central shaft 2*a* is released. When the load to press the key top 1 is released, the key top 1 is returned to its original state by the balanced elastic force of the springs 2*b*. The action of the springs 2*b* can keep the stable posture and operation of the key top 1. Even if the key top 1 is erroneously pushed at its central portion, the key top 1 does not push both the switches 3 simultaneously because the center shaft 2*a* acts as a stopper.

As described above, the key top holding structure according to the first embodiment of the present invention has at least the following advantages: The stopper nail is engaged with the center shaft of the casing. The key top is held to push the springs through the respective first protrusions and the switches through the respective second protrusions. The posture and operation of the key top is stabilized by the spring action, thereby preventing the occurrence of abnormal sound and looseness. The center shaft acts as a stopper, thereby preventing the two switches from being pushed simultaneously. The number of component parts can be reduced, and the assembly can be made easy.

(Second Embodiment)

Figure 6:
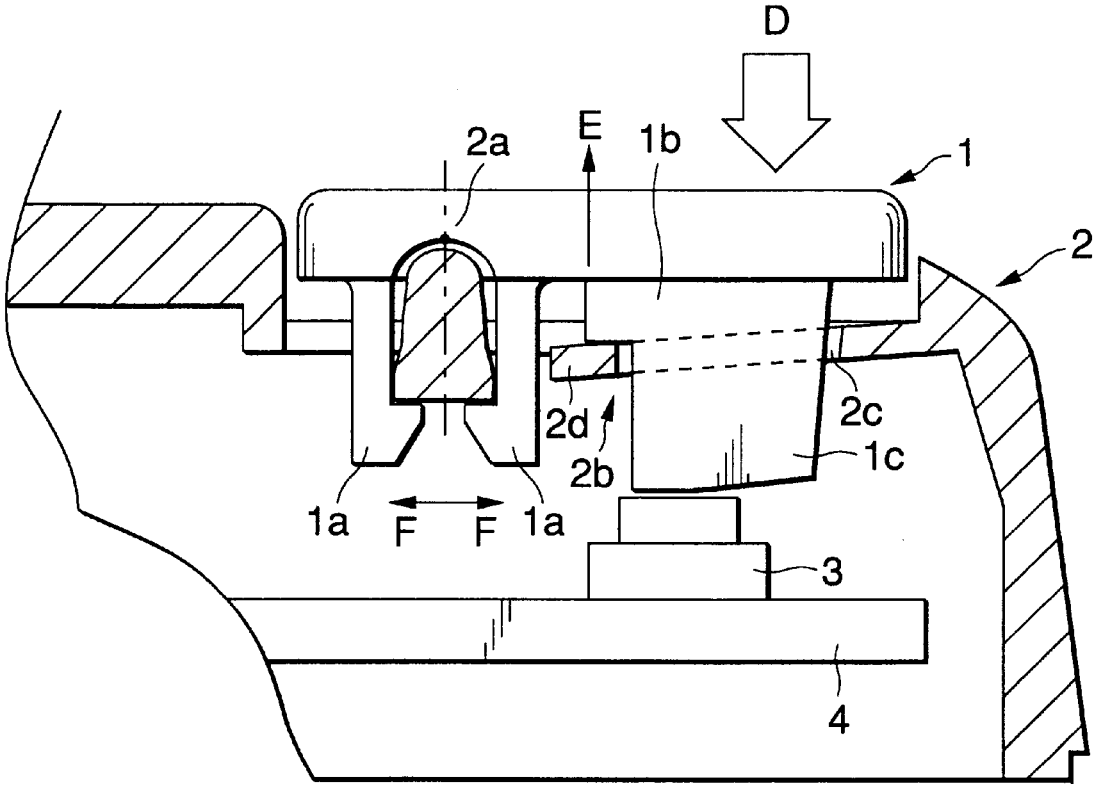
FIG. 6 is a sectional view showing a state in which a key top is incorporated in a casing according to a second embodiment of the present invention.

A key top holding structure according to a second embodiment of the present invention will be described with reference to FIG. 6. The second embodiment of the present invention is different from the first embodiment in that the key top holding structure of the present invention is applied to a rocking piano-key type arrangement for pushing a single switch.

A key top 1 has a stopper nail 1*a*, a protrusion portion 1*b* and a protrusion 1*c*. A casing 2 has a center shaft 2*a* and a spring 2*b*. The spring 2*b* of the casing 2 extends toward the center shaft 2*a* from the periphery of a recess portion of the casing 2 in which the key top 1 is to be set. The spring 2*b* is formed at its central portion with a hole 2*c* through which the protrusion 1*c* of the key top 1 is to be inserted. A switch 3 is provided on a printed board 4.

To incorporate the key top 1 in the casing 2, the stopper nail 1*a* of the key top 1 is forced onto the center shaft 2*a* of the casing 2 vertically. As the stopper nail 1*a* of the key top 1 is fitted onto the center shaft 2*a*, the protrusion portion 1*b* of the key top 1 abuts against a head 2*d* of the spring 2*b*. This protrusion portion 1*b* acts as a point of application of the spring 2*b*. The protrusion portion 1*c* for pushing the switch 3 is inserted through the hole 2*c* of the spring 2*b* of the casing 2, so that the key top 1 can be prevented from rotating when the key top 1 is assembled. The key top 1 can be assembled easily from the outside of the casing 2 in this manner.

When the stopper nail 1*a* of the key top 1 is entirely fitted onto the center shaft 2*a* of the casing 2, the key top 1 cannot be removed from the casing 2 unless the stopper nail 1*a* of the key top 1 is forcibly spread in the direction F. That is, the key top 1 cannot be taken off from the outside of the casing 2. Therefore, it is possible to prevent the key top 1 from being detached by an external impact such as dropping of the small-sized electronic equipment, or the like.

The spring 2*b* of the casing 2 is given downward tension by the protrusion 1*b* of the key top 1, while the key top 1 is always pushed in the direction E (upward) by the elastic force of the spring 2*b*. Since there is no spring on the opposite side with respect to the center shaft 2*a*, the head of the key top 1 abuts against the casing 2 so as to bear against the force of the spring 2*b*, thereby holding the top key in a stable manner. Since the key top 1 always receives the vertical tension in this manner, there is no fear that abnormal sound or looseness is produced in the key top 1 by vibrations of a calling vibrator or speaker singing.

When the key top 1 is pushed in the direction D for key operation, the key top 1 rotates about the center shaft 2*a* as a fulcrum, so that the switch 3 is pushed. When the load to press the key top 1 is released, the key top 1 is returned to its original state by the action of the spring 2*b*. The key top 1 is kept in a stable state by the action of the spring 2*b*.

As described above, the key top holding structure according to the second embodiment of the present invention has at least the following advantages: The stopper nail of the key top of a rocking piano-key type is engaged with the center shaft of the casing. The key top is held to press the spring through the first protrusion and the switch through the second protrusion. The center shaft of the casing acts as a fulcrum during the operation of the key top. Accordingly, the operation and posture of the key top is made stable by the spring action. It is possible to prevent abnormal sound or looseness from occurring. The number of component parts can be reduced, and the assembly can be made easy.

What is claimed is:

1. A key top holding structure for holding a key top on a casing to operate at least one switch, said structure comprising:

a key top including at least one first protrusion, at least one second protrusion and an elastic stopper nail; and a casing including a center shaft and at least one spring extending from a peripheral portion of said casing toward said central shaft, wherein said key top is pivotably held on said casing by engagement between said stopper nail and said central shaft to depress said spring through said first protrusion and said switch through said second protrusion.

2. A key top holding structure according to claim 1, wherein two of said at least one first protrusion are provided which are located opposite from each other with respect to said stopper nail, and two of said at least one second protrusion are provided which are located opposite from each other with respect to said stopper nail.

3. A key top holding structure according to claim 2, wherein said two of said at least one first protrusion are arranged symmetrically with respect to said stopper nail.

4. A key top holding structure according to claim 2, wherein said two of said at least one second protrusion are arranged symmetrically with respect to said stopper nail.

5. A key top holding structure according to claim 1, wherein each of said at least one spring has a central hole through which corresponding one of said at least one is insertable to depress corresponding one of said at least one switch.

6. A key top holding structure according to claim 1, wherein each of said at least one spring has substantially a U-shape.

7. A key top holding structure according to claim 1, wherein when said elastic nail is forced onto the said center shaft, said elastic nail is slid along an outer contour of said central shaft while being elastically expanded and thereafter elastically constricted to engage with said central shaft.

8. A key top holding structure according to claim 1, wherein a distal end of said central shaft, which is closer to said key top, is rounded.

9. A key top holding structure according to claim 1, wherein a proximal end of said central shaft, which is farther from said key top, is engageable with said stopper nail.

10. A key top holding structure according to claim 2, wherein two of said at least one spring are provided respectively biasing said two first protrusion in opposite direction about said central shaft, and said two springs cooperatively keep said key top at an original position.

11. A key top holding structure according to claim 1, wherein said spring biases said first protrusion to bring a portion of said key top in contact with said casing, thereby keeping said key top at an original position.

12. A method of assembling a key top onto a casing, said key top including at least one first protrusion, at least one second protrusion and an elastic stopper nail, and said casing including a center shaft and at least one spring extending from a peripheral portion of said casing toward said central shaft, said method comprising the steps of:

forcing said stopper nail onto said central shaft so that said elastic nail is slid along an outer contour of said central shaft while being elastically expanded; and continuously forcing said stopper nail onto said central shaft against a biasing force caused by contacting said first protrusion with said spring until said stopper nail is elastically constricted to engage with said central shaft.

13. A method of assembling a key top onto a casing according to claim 12, wherein said spring has an central hole, and said step of forcing includes forcing said stopper nail onto said central shaft while inserting said second protrusion into said central hole.

14. A method of assembling a key top onto a casing according to claim 12, wherein said step of forcing including forcing said stopper nail onto said central shaft from an outside of said casing.

15. A method for holding a key top in a casing, said key top including at least one first protrusion, at least one second protrusion and an elastic stopper nail, and said casing including a center shaft and at least one spring extending from a peripheral portion toward said center shaft, wherein said stopper nail of said key top is engaged with said center shaft of said casing so that said key top is held by said casing and so that during pivotal operation of said key top, said center shaft acts as a fulcrum and said spring is pushed by said first protrusion, while a switch is pushed by said second protrusion.

16. A key top holding method according to claim 15, wherein said key top is held in a state that said second protrusion of said key top is passed through a hole formed in said spring of said casing to push said switch.

17. A key top holding method according to claim 15, wherein said key top is attached to said casing from an outside of said casing, and said stopper nail is engaged with said center shaft so that said key top is prevented from being removed from the outside of said casing.

18. A key top holding structure comprising:

a key top including at least one first protrusion, at least one second protrusion and an elastic stopper nail; and a casing including a center shaft and at least one spring extending from a peripheral portion toward said center shaft, wherein said stopper nail of said key top is engaged with said center shaft of said casing so that said key top is held by said casing and so that during pivotal operation of said key top, said center shaft acts as a fulcrum and said spring is pushed by said first protrusion, while a switch is pushed by said second protrusion.

19. A key top holding structure according to claim 18, wherein said key top is held in a state that said second protrusion of said key top is passed through a hole formed in said spring to push said switch.

20. A key top comprising:

at least one first protrusion for pushing a spring provided in a casing;

at least one second protrusion for pushing a switch, said second protrusion being insertable into a hole formed in said spring; and an elastic stopper nail engageable with a center shaft provided in said casing to hold said key top.

21. A casing comprising:

a center shaft to be used as a fulcrum during pivotal operation of a key top, and engageable with a stopper nail of said key top to hold said key top; and at least one spring, each extending from a peripheral portion toward said center shaft and having a hole formed therethrough.

22. A casing according to claim 21, wherein each of said at least one spring is provided with a gradient at its outer circumferential portion for improving mold releasing property during resin molding.

23. A method of assembling a key top and a casing together, wherein a stopper nail of said key top is pushed onto and engaged with a center shaft of said casing so that at least one first protrusion of said key top is brought into contact with at least one spring of said casing, while at least one second protrusion of said key top is passed through a corresponding hole formed in said at least one spring of said casing to push a respective switch, whereby said key top is attached from an outside of said casing and prevented from being removed from the outside of said casing.

24. An inter-call receiver comprising:

at least one switch;

a key top having at least one first protrusion, at least one second protrusion for pushing said at least one switch respectively, and an elastic stopper nail; and a casing having a center shaft for holding said key top and at least one spring extending from a peripheral portion toward said central shaft, said central shaft being used as a fulcrum during pivotal operation of said key top and engaged with said stopper nail of said key top, and said at least one spring being in contact with said at least one first protrusion, respectively.

* * * * *